US005078001A

United States Patent [19]

Bakermans

[11] Patent Number: 5,078,001

[45] Date of Patent: Jan. 7, 1992

[54] MANUFACTURE, SLITTING, AND REELING OF TWO-OUT TERMINAL STRIP

[75] Inventor: Johannes C. W. Bakermans, Harrisburg, Pa.

[73] Assignee: AMP Incorporated, Harrisburg, Pa.

[21] Appl. No.: 672,057

[22] Filed: Mar. 13, 1991

Related U.S. Application Data

[63] Continuation-in-part of Ser. No. 532,298, Jun. 1, 1990, Pat. No. 5,062,289.

[51] Int. Cl.[5] ..... B21D 43/28; H01R 43/00

[52] U.S. Cl. ..... 72/324; 72/404; 72/426; 29/874; 29/335; 29/564; 29/566.2; 83/430; 242/56.2; 242/56.4

[58] Field of Search ..... 72/324, 338, 339, 404, 72/426, 129, 185, 326, 332, 335; 29/874, 882, 33 Q, 33 S, 564, 565, 566.1, 566.2; 83/430; 242/56.2, 56.4, 56.5, 56.8

[56] References Cited

U.S. PATENT DOCUMENTS

| | | | |
|---|---|---|---|
| 2,435,441 | 2/1948 | Grouse | 29/874 |
| 3,581,389 | 6/1971 | Mori | 242/56.8 |
| 4,018,177 | 4/1977 | McKee | 29/874 |
| 4,497,196 | 2/1985 | Bakermans | 72/405 |
| 4,819,476 | 4/1989 | Bakermans | 72/456 |
| 4,887,452 | 12/1989 | Bakermans | 72/335 |

FOREIGN PATENT DOCUMENTS

| | | | |
|---|---|---|---|
| 510567 | 10/1930 | Fed. Rep. of Germany | 72/404 |
| 269331 | 6/1989 | German Democratic Rep. | 72/404 |
| 227933 | 11/1985 | Japan | 72/324 |

*Primary Examiner*—Daniel C. Crane

[57] ABSTRACT

Two-out terminal strip (44, 44') is produced by stamping and forming the strip such that the terminals (40) on one of the side edges (36) extend laterally in a first direction of the plane of the stock strip (124) and the terminals (40') on the other side edge (36') extend laterally in a second direction which is the opposite of the first direction. The two-out strip is slit along the centerline (30) of the central carrier portion and the resulting single strips (44, 44') of terminals are wound on reels (46, 46'). One of the strips (44') is wound by rotating the reel (46') in a clockwise direction and the other strip (44) is wound on a reel (46) by rotating the reel in a counterclockwise direction. The two strips will then be in the same orientation on their respective reels and re-reeling of one of the strips is not necessary.

15 Claims, 9 Drawing Sheets

MANUFACTURE, SLITTING, AND REELING OF TWO-OUT TERMINAL STRIP

CROSS-REFERENCE TO RELATED APPLICATION

This Application is a continuation-in-part of application Ser. No. 532,298 filed June 1, 1990, now U.S. Pat. No. 5,062,289, issued Nov. 5, 1991.

FIELD OF THE INVENTION

This invention relates to methods and apparatus for manufacturing two-out terminal strip in a manner which does not require re-reeling of either of the strips produced in order that the terminals of both strips will be in a preferred orientation.

BACKGROUND OF THE INVENTION

Electrical terminals are frequently manufactured in the form of a continuous strip containing individual terminals in side-by-side relationship. The terminals may be directly connected to each other by portions of the strip or the terminals may be spaced apart and integral with one side edge of a continuous carrier strip. In either event, it is usually a requirement that the terminals of the strip be reeled onto a reel in a particular orientation so that they will be removed from the reel in a preferred orientation for insertion into the cavities of a connector housing or for crimping in a crimping press onto the ends of wires. When terminals are manufactured as one-out strip (strip having one terminal in each pitch length of the strip), it is customary to design the terminals and reel the terminals after manufacture in a manner which that the terminals of the strip will be in the required and preferred orientation when they are subsequently de-reeled at the time of crimping or at the time of insertion into cavities in a connector.

Under some circumstances, economies in the manufacture of terminal strip can be achieved if the strip is produced as two-out strip. A two-out terminal strip will commonly have a central carrier strip having side edges with terminals extending from each of the side edges. Ordinarily, two-out strip is manufactured with the terminals in both of the side edges in the same orientation; for example, if the terminals have formed portions which extend laterally of the strip, the formed portions of all of the terminals will extend in the same direction from the plane of the carrier strip. When two-out strip is manufactured, the central carrier strip is slit along its centerline thereby producing two individual strips which are reeled in the conventional manner. One of these strips produced will be in the preferred and proper orientation for subsequent processing such as crimping or insertion into the cavities of a connector. The other strip produced will, however, not be in the correct orientation and it is therefore necessary to re-reel the other strip of terminals before they can be further processed. The re-reeling process adds significantly to the cost of producing terminals in strip form and the necessity for re-reeling to some extent cancels out the economic advantages achieved in manufacturing the strip by the two-out method.

The present invention is directed to the achievement of a method and apparatus for manufacturing, slitting, and reeling of two-out terminal strip in a manner which avoids the necessity of re-reeling one of the strips of terminals produced by the two-out process.

THE INVENTION

The invention comprises a method of manufacturing first and second continuous strips of articles, such as electrical terminals, which are wound on first and second reels in the same orientation. Each strip of articles comprises individual articles in side-by-side aligned parallel relationship to each other and carrier strip means, the individual articles being integral with the carrier strip means. The method comprises the steps of providing stock strip material which has a stock strip centerline, first and second stock strip side edges, and a width which is equal to the combined widths of the first and second strips of articles. A first series of articles are produced by performing first stamping operations on a first portion of the stock strip which is between the first stock strip side edge and the centerline. A second series of articles are produced by performing second stamping operations on a second portion of the stock strip which is between the second stock strip side edge in the centerline. The first and second series of articles are separated from each other along the stock strip centerline thereby leaving carrier strip means on each of the strips of articles which are produced by the severing operation. Finally, the first strip of articles is wound on a first reel by rotating the first reel in a first direction. The second strip of articles is wound on the second reel by rotating the second reel in a second direction of rotation which is opposite to the first direction of rotation. In one embodiment, a carrier portion is provided on each side of the centerline when the first and second series of articles are produced so that carrier strip means for each of the first and second continuous strips of articles are provided, the carrier strip means in this instance being a continuous carrier strip with the articles of each strip extending laterally from one of the side edges of the strips associated carrier strip.

Apparatus for the practice of the invention as described above comprises a stamping machine, strip feeding means, strip separating means, and first and second reeling means. The feeding means is effective to feed the stock strip along a feed path which extends through the stamping machine and to the separating means. The feed path has a feed path centerline which coincides with the centerline of the stock strip and first and second feed path side edges which coincide with the first and second stock strip side edges. The stamping machine has first and second sets of punches and dies therein, the first set being located between the first feed path side edge and the feed path centerline and the second set being located between the second feed path side edge and the feed path centerline. The first and second sets of punches and dies have punches and dies for producing a first series of articles and a second series of articles in the stock strip. The strip separating means is located downstream, relative to the direction of strip feed, from the first and second sets of punches and dies. The separating means is effective to separate the strip along the stock strip centerline while it is being fed therepast. The first and second reeling means are downstream from the separating means, the first reeling means having means for rotating the first reel in a clockwise direction and the second reeling means having means for rotating the second reel in a counter-clockwise direction.

THE DRAWING FIGURES

Figure 7:
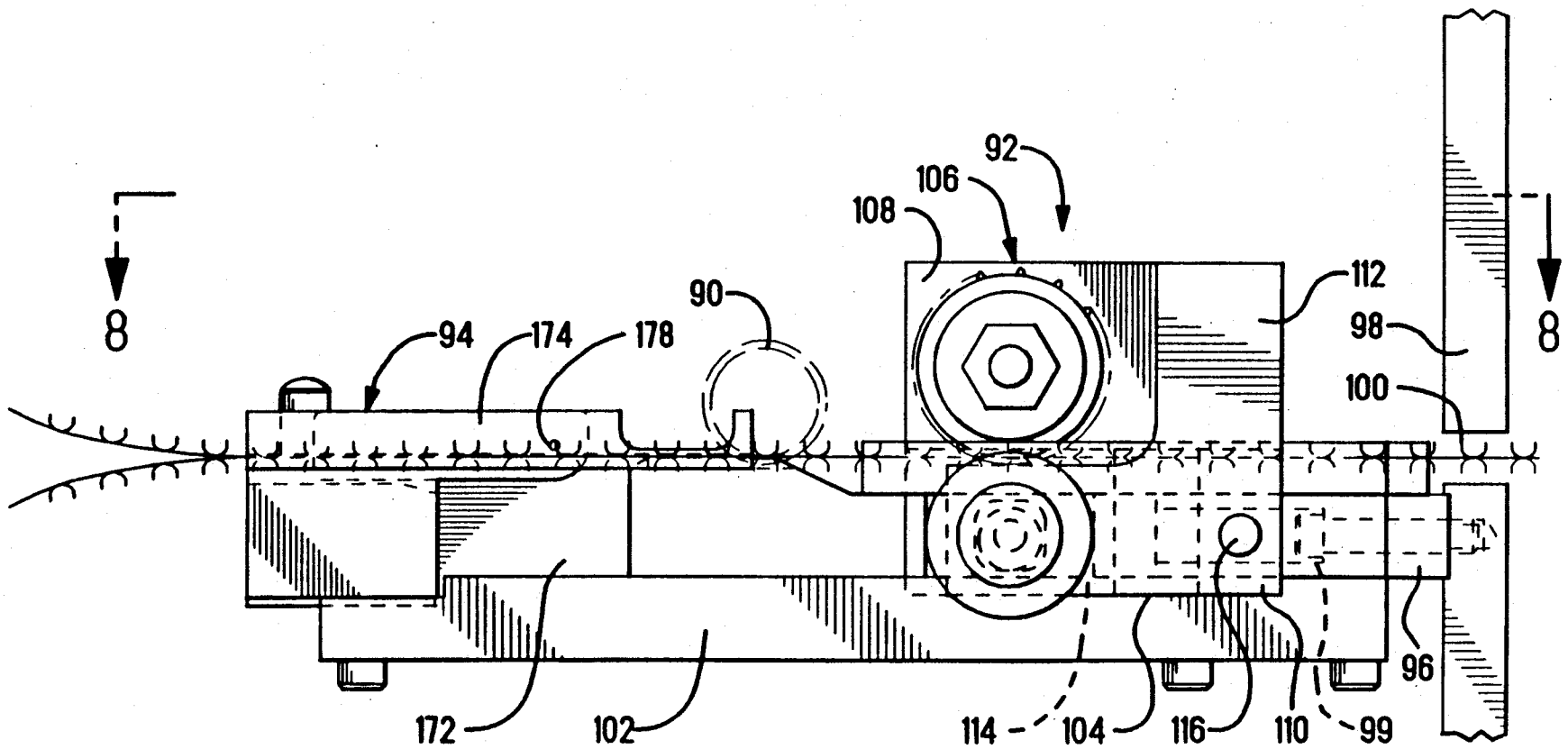
FIG. 7 is a top plan view, on an enlarged scale, of the strip separating, strip slitting, and feeding means for the machine of FIG. 6.
Figure 8:
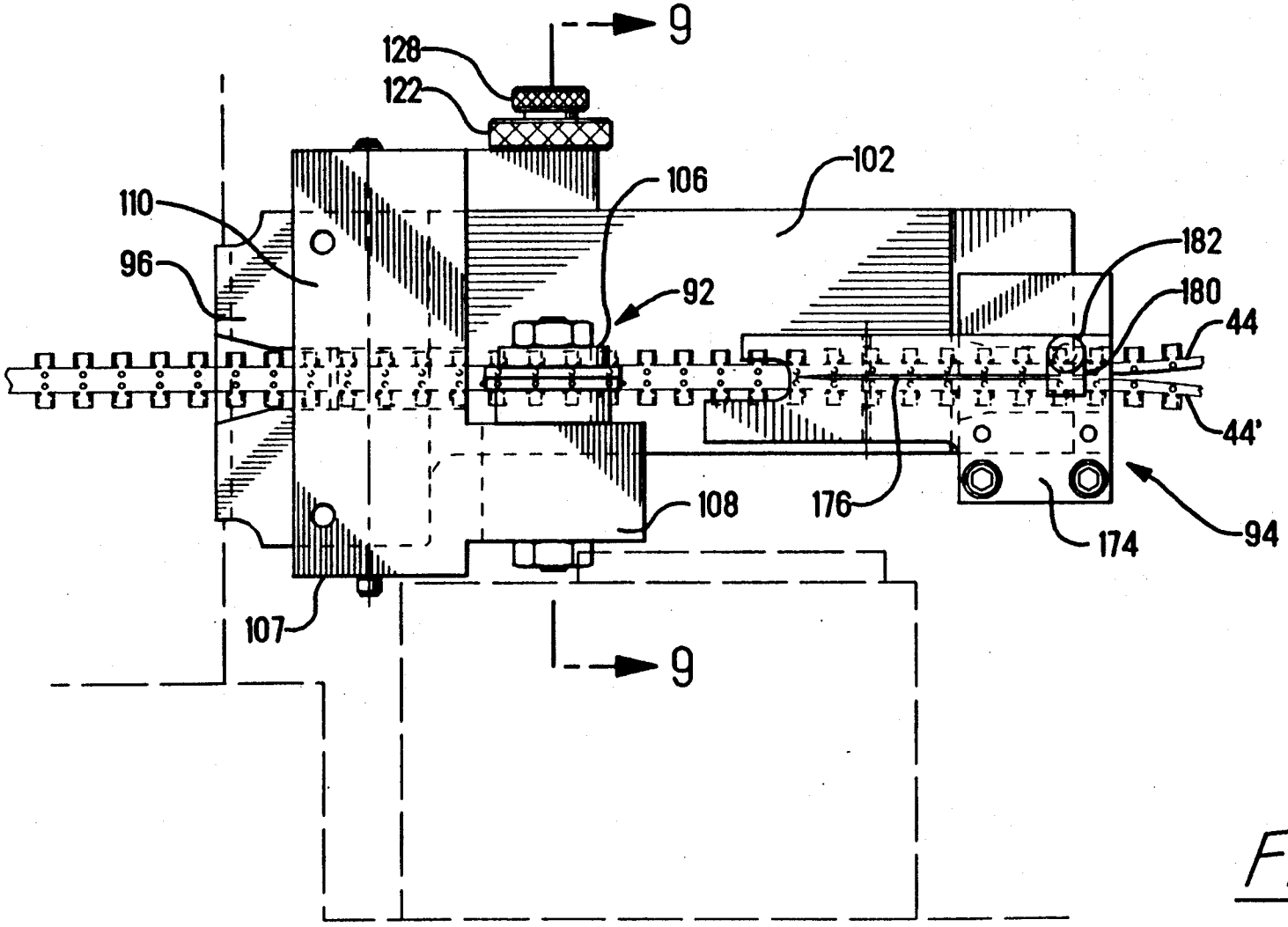
Figure 9:
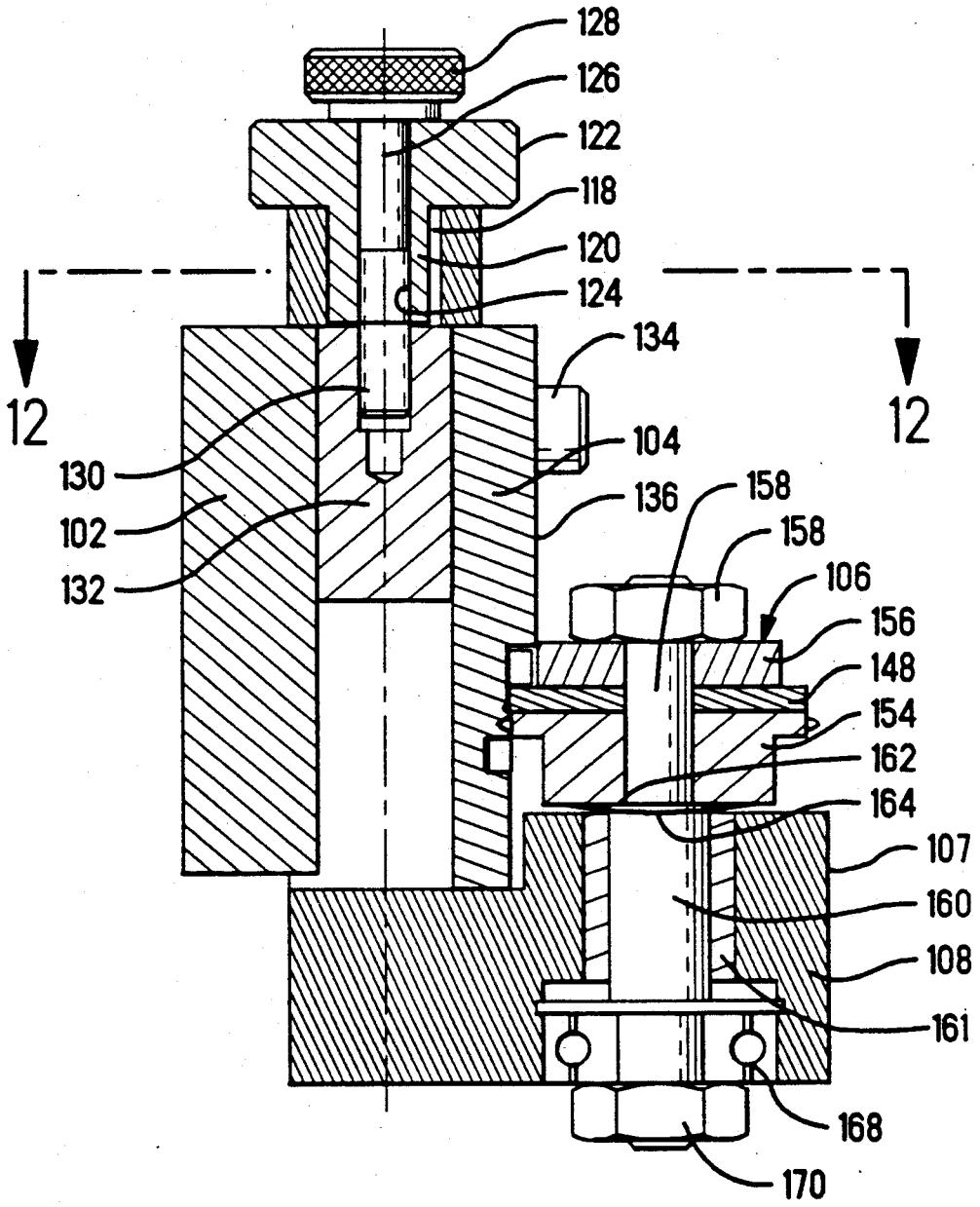

FIGS. 8 and 9 are views looking in the direction of arrows 8—8 and 9—9 of FIGS. 7 and 8.

Figure 10:
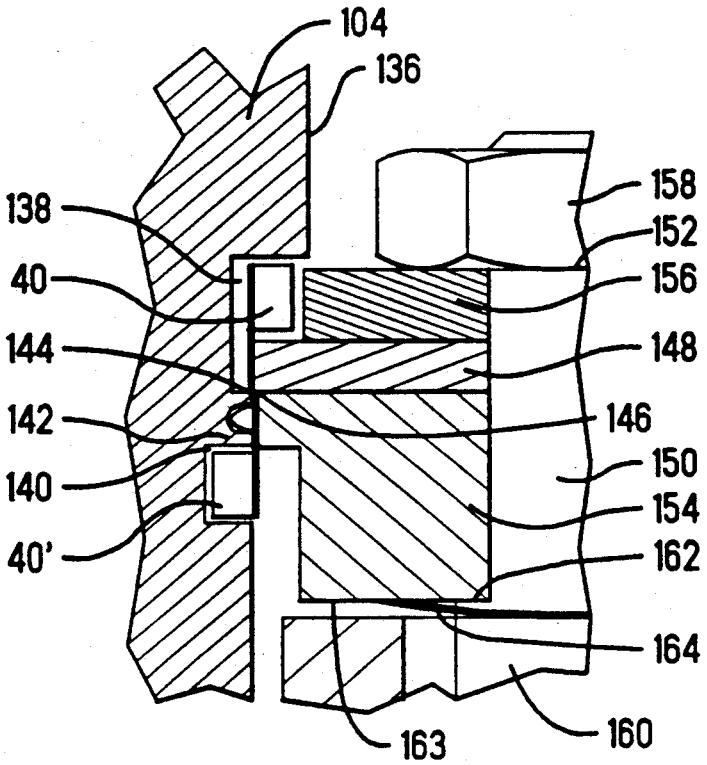

FIG. 10 is an enlarged fragmentary view showing portions of the slitter which are also shown in FIG. 9, this view showing the positions of the parts when the strip material is being slit and the slitting blade is in its operative position.

Figure 11:
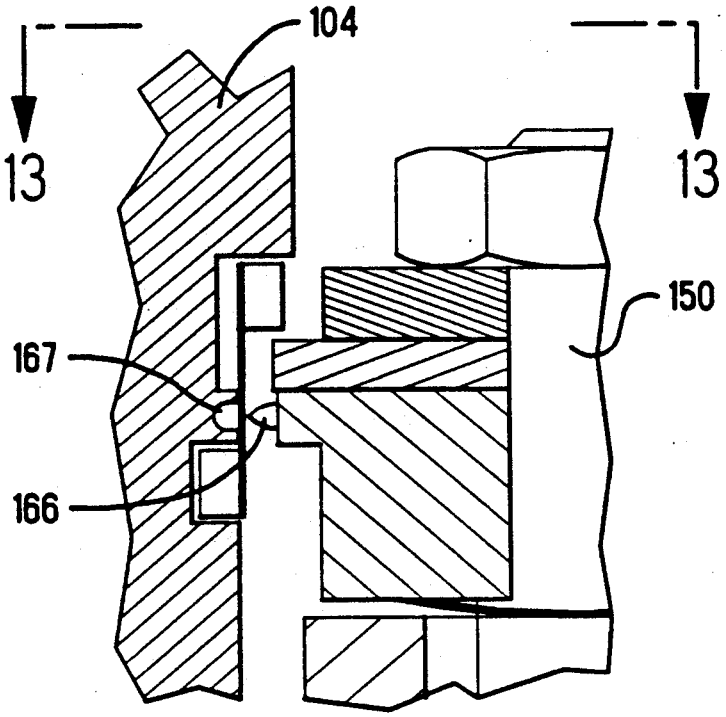

FIG. 11 is a view similar to FIG. 10 but showing the manner in which the slitting blade assembly is moved to permit the strip material to be initially threaded through the slitter and past the slitting wheel.

Figure 12:
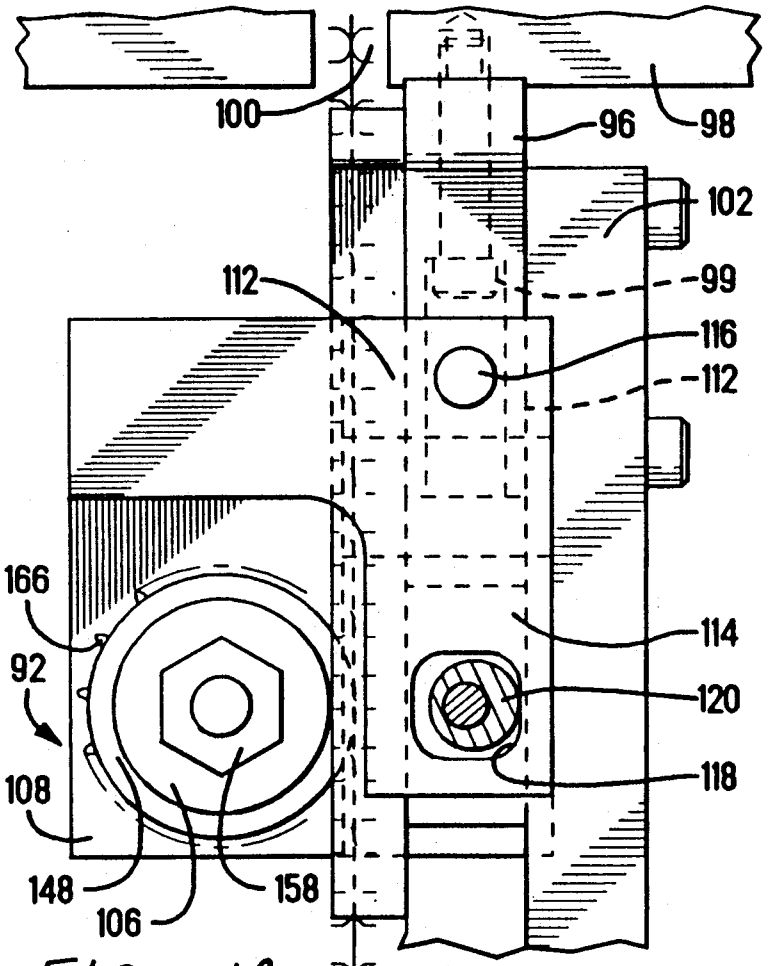

FIG. 12 is a view looking in the direction of the arrows 12—12 of FIG. 9.

Figure 13:
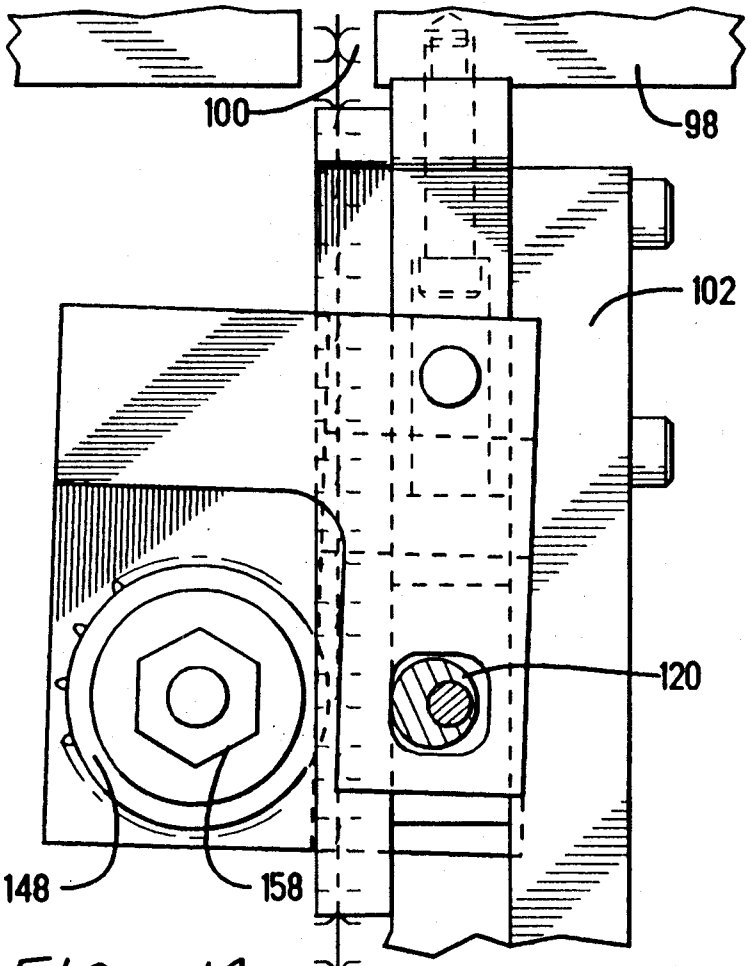

FIG. 13 is a view similar to FIG. 12 but looking in the direction of the arrows 13—13 of FIG. 11.

Figure 14:
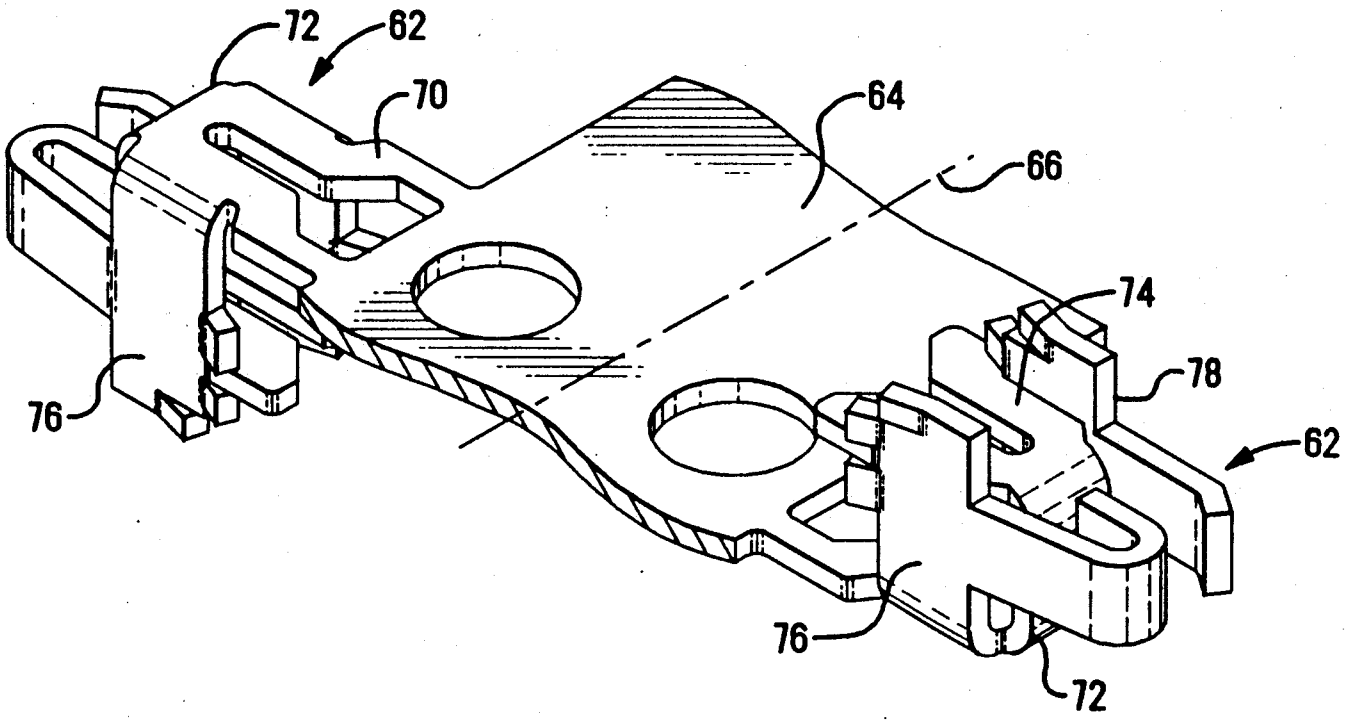

FIG. 14 is a perspective view of a short section of two-out strip having relatively complex terminals extending from its side edges.

THE DISCLOSED EMBODIMENT

Figure 1:
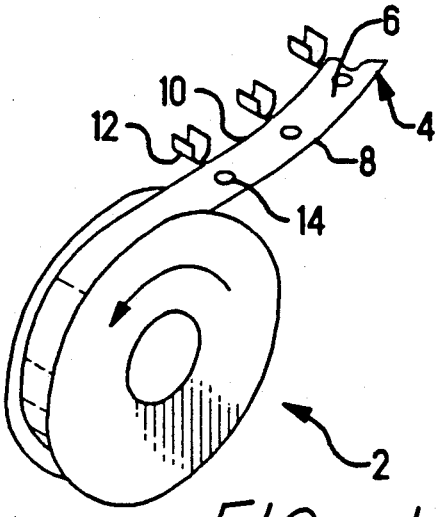
FIG. 1 is a perspective view of a typical reel of terminals in continuous strip form.
Figure 2:
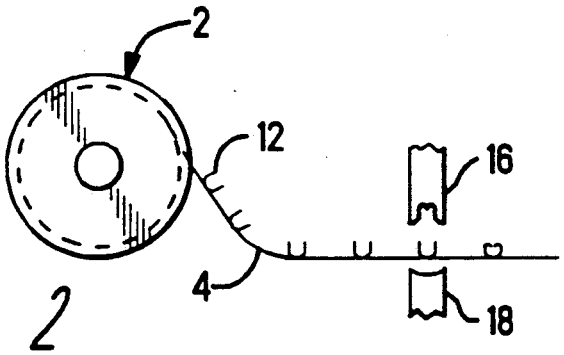
FIG. 2 is a diagrammatic view illustrating the manner in which the strip is de-reeled and fed to a crimping apparatus at which the individual terminals are crimped onto the ends of wires.
Figure 3:
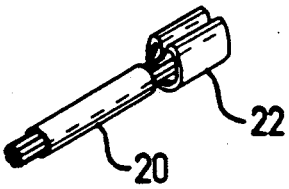
FIG. 3 is a view showing a terminal crimped onto the end of a wire.

FIG. 1 shows a reel 2 containing terminal strip 4 which is wound thereon, the terminal strip comprising a continuous carrier strip 6 having side edges 8, 10, pilot holes 14, and spaced apart terminals 12 which are integral with, and which extend from, the side edge 10. The terminals 12 shows are simple U-shaped terminals and it will be noted the terminals are directed upwardly with respect to the strip so that when wound on the reel, they will be directed radially outwardly. When the terminals of the strip are crimped onto wires, the reel is mounted on a suitable axis as shown in FIG. 2 and the strip is de-reeled by feeding the strip from the top of the reel along a path which extends between a crimping die 16 and a crimping anvil 18. Note that the terminals must be in the orientation shown, that is, with their open sides directed upwardly when they arrive on the anvil 18 in order to permit placement of the end portion of a wire 20 in each terminal and crimping of the terminal onto the wire as shown in 22. In machines of the type shown in FIG. 2, a suitable severing or shearing device is provided (not specifically shown) for shearing each terminal from the carrier strip 6 when the crimping operation is carrier out.

The terminal strip 4 can be manufactured by a conventional one-out stamping and forming process in which one terminal is produced on each pitch (spacing between pilot holes 14) in the strip. The tooling will be designed such that the strip 4 will emerge from the stamping and forming die in the orientation shown in FIG. 1 and it can then be reeled onto the reel by rotating the reel in a counter-clockwise direction so that when de-reeled, the strip will be properly oriented for the crimping means 16, 18.

Figure 4:
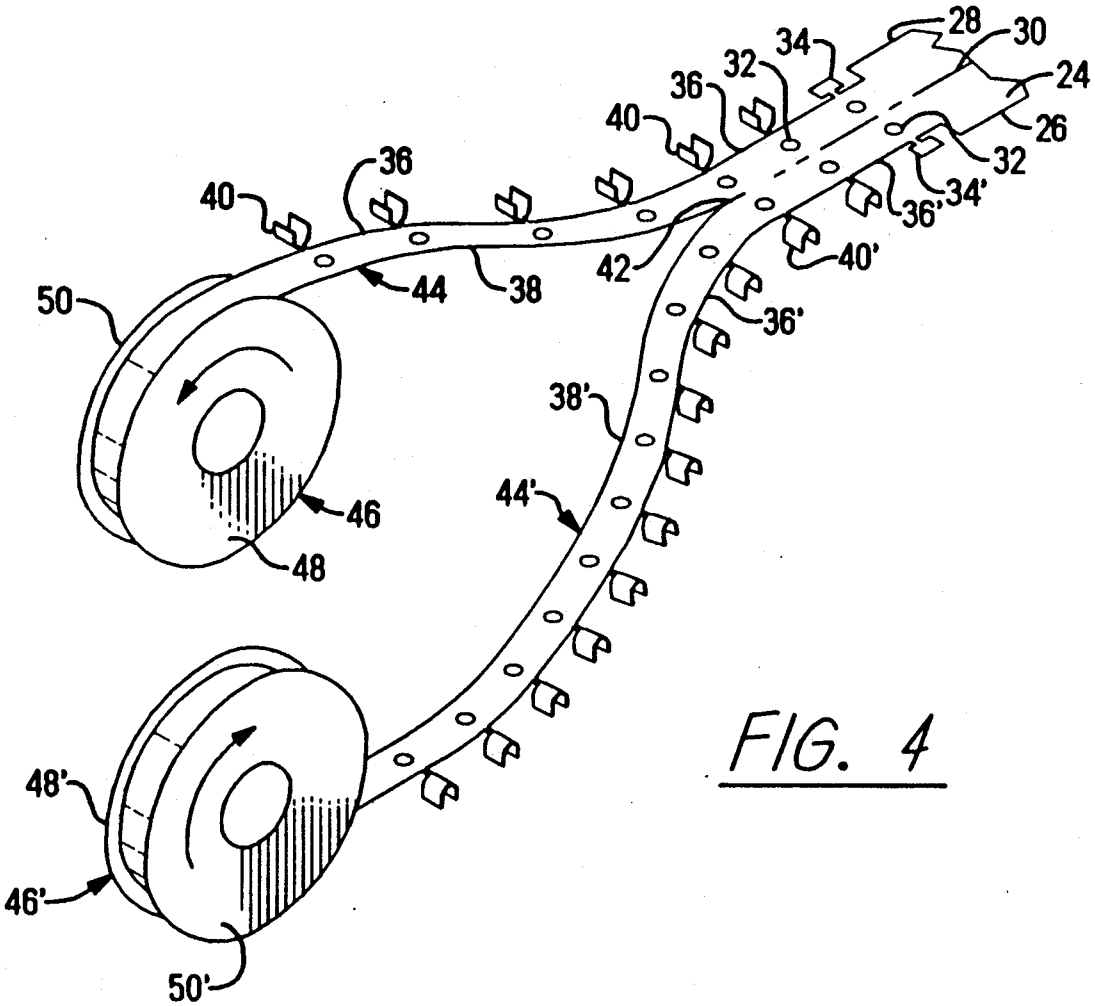
FIG. 4 is a diagrammatic view which illustrates the essential features of the present invention for producing strips of terminals by the two-out method without the requirement that one of the strips be re-reeled.

FIG. 4 diagrammatically illustrates the manufacture, slitting, and reeling of two-out strip in accordance with the present invention. The two strips of terminals 44, 44' are manufactured from stock material 24 having stock strip side edges 26, 28. The stock strip is provided with pilot holes 32, 32' on each side of a stock strip centerline 30. When the strip is fed through the stamping and forming machine, blanks 34, 34' are initially stamped from the strip thereby producing two fresh side edges 36, 36'. The blanks 34 are formed upwardly as shown at 40 in FIG. 4 and the blanks 34' are formed downwardly as shown at 40'. The central carrier strip portion is then slit or severed as shown at 42 along the original stock strip centerline 30. This slitting operation produces the two strips of terminals 44, 44' each strip comprising a carrier strip having side edges 36, 38, 36', 38' and terminals 40, 40' extending from the side edges 36, 36'. The strip 44 is fed from the slitting site 42 to a reel 46 having sides 48, 50. This strip is fed to the top of the reel 46 and the reel is rotated in a counter-clockwise direction. The strip 44' is fed to the bottom of the reel 46' which has sides 48', 50' and the reel is rotated in a clockwise direction. The two resulting reels 46, 46' are identical and it is merely necessary to flip the reel 46' with respect to a diametric axis extending through the center of the reel. The reels can be shipped directly from the manufacturing site to the ultimate user who can place them in a crimping press of the type shown in FIG. 2 without re-reeling either of the terminal strips 44, 44'.

Figure 5:
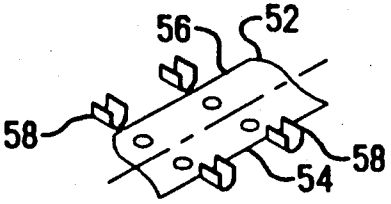
FIG. 5 PRIOR ART
FIG. 5 is a fragmentary view showing a short section of two-out strip produced by a prior art method.

FIG. 5 shows a short section of two-out strip produced in accordance with known prior art methods. The strip 52 has side edges 54, 56 and a centerline as shown. All of the open U terminals 58 face upwardly and are in the same orientation. When the strip is severed along the stock strip centerline to produce two separate strips of terminals, one of the resulting strips, the strip shown on the left of the centerline in FIG. 5, can be wound on a reel in a manner such that it can be supplied directly to the ultimate user and will be in the proper orientation. The other strip, however, cannot possibly be wound on a reel in its final orientation and it is therefore necessary to re-reel the second strip before it can be supplied to the user.

The terminals shown in FIGS. 1-5 are extremely simple open-U-type terminals, but the invention can be employed in the manufacture of relatively complex stamped and formed terminals as shown at 62 in FIG. 14. This Figure shows a short section of two-out terminal strip of a type which is described fully in application Ser. No. 532,298. The strip comprises a central carrier strip 64 having a centerline 66 and pilot holes on each side of the centerline. The terminals 62 are integral with the side edges of the strip, the terminals on the right being formed upwardly as viewed in the drawing, while those on the left are formed downwardly. Each terminal has a plate section 70 which is integral with its associated side edge and which is provided with a wire-receiving slot. An extension 72 of the plate section is formed laterally and then back towards the side edge of the strip as shown at 74 and is provided with a wire-receiving slot which is in alignment with the slot in the section 70. Arms 76, 78 extend laterally from the sides of the sections 70 and the arm 76 has an outwardly extending and reversely bent ear as shown while the arm 78 has a relatively short extension which is formed towards the extension on the arm 76. The tooling for stamping and forming terminal strip of the type shown in FIG. 14 is described in application Ser. No. 532,298. This tooling can be provided in a stamping and forming machine module 80 of the type described below which incorporates the strip splitting or severing and reeling devices of the present invention.

Figure 6:
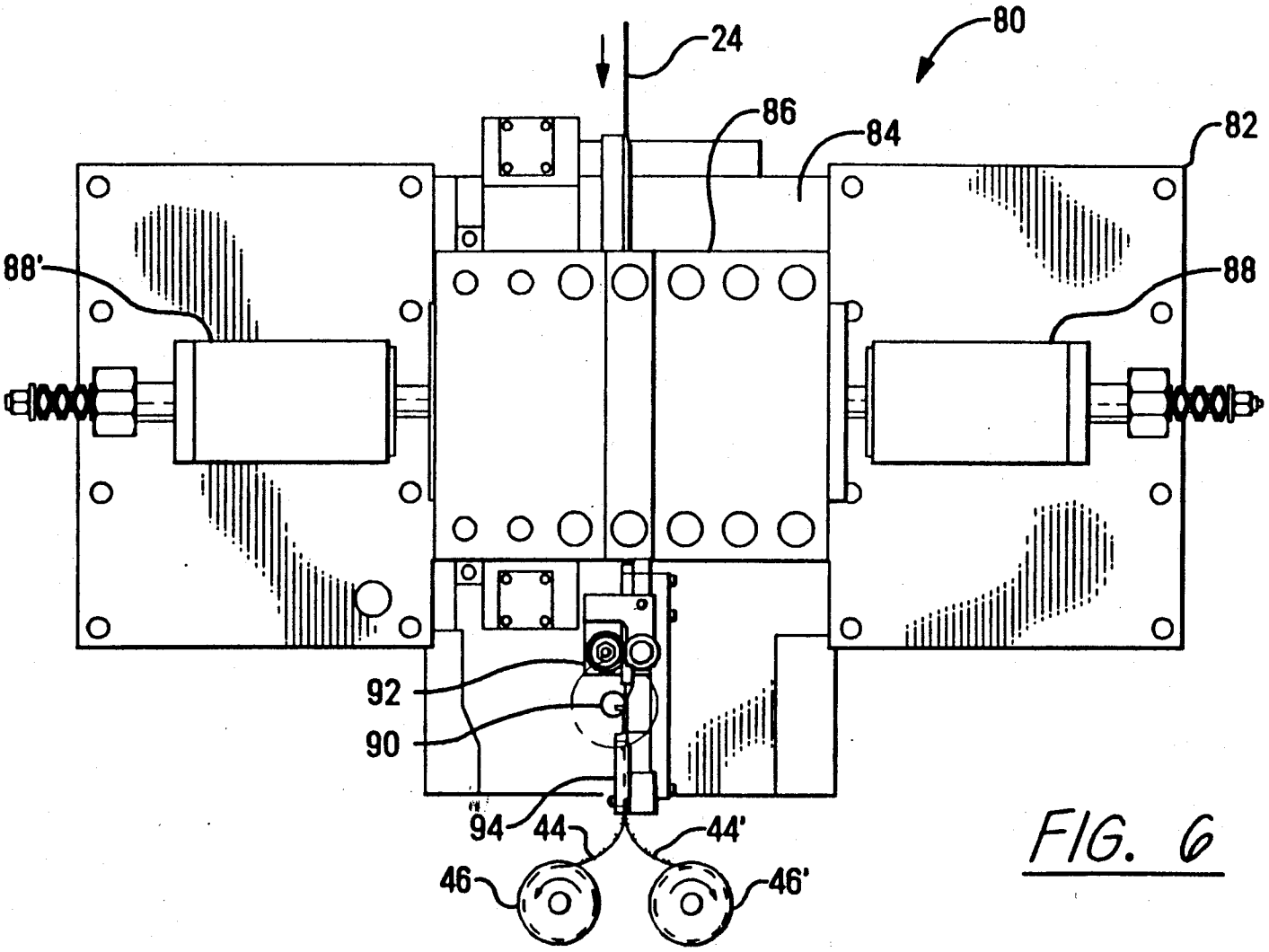
FIG. 6 is a top plan view of a stamping and forming machine used in the practice of the invention.

The stamping and forming machine module 80, FIG. 6, is of the type described in U.S. Pat. Nos. 4,819,476 and 4,497,196. This module will be described only briefly and to the extent necessary for an understanding of the present invention and the manner in which the present invention can be incorporated into the machine module.

The module comprises a module housing 82 having a top surface 84 which supports a tooling housing 86. The tooling housing contains a punch assembly and a die assembly which stamp and form the strip material 24 to produce the two-out strip shown in FIG. 4. The strip is fed by pulling the strip through the module by a feed sprocket wheel 90 which is intermittently indexed by a geneva mechanism. The punch and die assemblies contained in the housing 86 are reciprocated towards and away from each other by oscillating levers, the upper ends of which are shown at 88, 88' as described in U.S. Pat. No. 4,497,196.

The two-out strip having the terminals 44, 44' integral with its side edges emerges from the housing 86 and is slit continuously during operation of the machine by a slitter assembly 92. The strip is divided by a divider assembly 94 which is downstream from the slitter assembly and the divided strips 44, 44' are reeled on reels which are rotated in the directions indicated in FIG. 6.

The slitter assembly and the divider assembly are supported adjacent to a wall 98 of the housing 86 by a support plate 96 and an additional support plate 102, see FIGS. 7–9. Support plate 96 is fastened to the wall 98 by fastener means 99 adjacent to a slot 100 through which the strip emerges. The support plate 102 is secured to the mounting plate 96 and extends, parallel to the strip feed path, past the slitter assembly 92, past the feed sprocket 90, and to the divider assembly 94. A stock guide plate 104 is secured to the support plate 102 on the strip feed path by fasteners as shown in FIG. 7 and a rotary slitter assembly 106, FIG. 9, is mounted on this stock guide plate 104. The rotary slitter assembly comprises a frame 107 having a base portion 108 from which a vertical arm 110 extends. The arm 110 has an ear 112 on its upper end which is above the upper surface of the stock guide 104 and the ear has an extension 114. The frame 107 is pivotally supported on the stock guide by a pivot pin 116 which extends through aligned holes and into the base portion 108. A square hole 118, FIGS. 12 and 13, is provided in the extension 114 and an eccentric 120 is received in this hole. The eccentric has a bore 124 and a knob 122 on its upper end. A clamping screw 126, FIG. 9, extends through the bore and has a threaded lower end 130 which is received in the threaded opening in a eccentric support block 132. The block 132 in turn is secured to the stock guide 104 by fasteners 134. The function of the eccentric 120 will be explained below.

The rightwardly facing surface 136 of the stock guide 104 (FIG. 10) has spaced apart upper and lower recesses 138, 140 which are separated by a rib 142. The edge 144 formed by the lower wall of the recess 138 and the surface of the rib 142 functions as a fixed shearing edge for shearing the strip to produce the two separate terminal strips 44, 44'. Fixed shearing edge 144 cooperates with a rotary shearing edge 146 which is provided or on a slitting wheel 148. The slitting wheel is mounted on the reduced diameter portion 150 of a slitter shaft 152. A locator wheel 154 is carried by this shaft beneath the slitting wheel 148 and a lock washer 156 is provided above the slitting wheel. A nut 158 is threaded on the upper end of the shaft 152. Shaft 152 has an enlarged diameter intermediate portion 160 which is supported in a needle bearing 161 and which extends through the base portion of the frame. A shoulder 162 is formed between the portions 160, 150 of the shaft and a spring washer 164 is interposed between the downwardly facing surface 163 of the positioning wheel and the upwardly facing surface of the base of the frame. The positioning wheel has teeth 166 on its periphery which are received in the holes of one of the rows of index holes in the strip material. The function of this wheel is precisely to position the strip material during the slitting operation which is illustrated in FIG. 10. A recess 167 is provided in the rib 142 for the reception of these teeth as also shown in FIG. 10. On its lower end, the shaft is rotatably supported in a ball bearing assembly 168 and a lock nut 170 is provided on the lower end of the shaft as viewed in FIG. 9. During normal operation of the machine module, the strip stock is fed through the housing 86 and the two-out strip emerges from the slot 100 in the wall 98. As the two-out strip is pulled through the slitter or slitting assembly, it is sheared by the fixed shearing edge 144 on the stock guide 104 and the rotary shearing edge 146 on the slitting wheel.

The strip divider assembly 94, FIGS. 7 and 8, is supported by a mounting block 172 which is secured to the plate 102 and a mounting plate 174 which is secured to the mounting block. The strip is divided by a thin blade-like strip divider 176 which is pivotally supported on a vertical pivotal axis 178. The location of the divider is such that one of the resulting strips 44 emerges from the module above the plane of the strip divider and the other strip 44' emerges from beneath the divider. Block 172 and plate 174 have channels in their opposed surfaces for the terminals 44, 44'. Divider 176 extends along these channels as shown in FIGS. 7 and 8. A latch 180 is provided on plate 174 and is pivoted to the plate as shown at 182. This latch normally maintains the divider in the position of FIG. 7 but permits the divider to be swung outwardly from the channels at the time of start up of the machine. When the divider is swung outwardly, the strip can be threaded through the divider assembly 94.

During operation of the machine module, the frame 107 will be in the positions shown in FIGS. 9, 10, and 12 so that the rotary shearing edge 146 overlaps by a slight amount the fixed shearing edge 144 and the strip will be slit as it moves past these two edges as shown in FIG. 10. It is necessary, however, to move the frame rightwardly to the position of FIG. 11 when the strip material is initially being threaded through the slitter assembly and past the divider assembly. When a strip is being initially threaded through the machine, the screw 126 is loosened so that the eccentric 120 can be rotated by means of the knob 122 from the position of FIG. 12 to the position of FIG. 13. Such rotation of the eccentric will cause the frame 107 to pivot about the pivotal axis on which it is mounted thereby moving the slitter wheel rightwardly so that the strip material can be passed between the guide 104 and the wheel. Prior to starting the stamping and forming machine, the eccentric is rotated back to the position of FIG. 12 and the clamping screw 126 is tightened thereby to lock the eccentric in the position of FIGS. 9 and 12 and maintain the cutting or slitting wheel in the positions shown in those figures.

It is preferably to use a stamping and forming machine of the type shown in FIG. 6 and described in U.S. Pat. Nos. 4,497,196 and 4,819,476 in the practice of the invention for the reason that the punches and dies must be clear of the formed terminals 44, 44' when the strip is fed through the tooling housing 86. In machines of that type, the punch assembly and the die assembly both move away from the strip feed path and the strip is not in contact with the die assembly during the feeding interval. In a conventional stamping and forming press having fixed lower tooling and movable upper tooling, the upper tooling moves towards and away from the lower tooling and the strip is fed in a horizontal plane. The strip usually is supported on the lower tooling and the laterally extending portions of the terminals would be in contact with the lower tooling. Under those conditions, the strip could not be fed because of the interference of the lower tooling with the downwardly extending portions of the strip. It would be necessary to design the tooling such that the strip would not be in contact with the lower tooling during strip feeding if a conventional press were used.

In FIG. 6, the reels are shown as being supported on vertical axes for purposes of illustration. In practice, the reels are supported on horizontal axes and the reels are in vertical planes. The strip is fed by the feed sprocket past the divider assembly 94 and forms a loop between the divider and the reels. A sensor is provided which detects the size of the loop and energizes wind-up motors for the reels when the loop reaches a predetermined size. This method of controlling the reeling of terminal strip while it is being produced in a stamping and forming machine is well known and is used on conventional machines.

During operation, the strip material is fed into the tooling housing 86 and the terminals 44, 44' are produced. The strip emerges from the housing 86 and is slit by the slitting assembly 92. The strip is divided by the divider 94 and wound on the reels 46, 46'. The reel 46' is rotated in a clockwise direction and the reel 46 is rotated in an anti-clockwise direction. The two strips will be wound on the reels in the same orientation and a re-reeling step, as required by prior art methods of manufacturing two-out strip, is avoided.

The advantage of the invention is the avoidance of the re-reeling step in the manufacture of two-out strip.

I claim:

1. A method of manufacturing first and second continuous strips of articles which are wound on first and second reels in the same orientation, each strip of articles comprising individual articles in side-by-side aligned parallel relationship to each other, and carrier strip means, the individual articles being integral with the carrier strip means, the method comprising the steps of:

providing stock strip material which has first and second stock strip side edges, a separation line which is between the stock strip side edges, and a width which is equal to the combined widths of the first and second strips of articles, producing a first series of articles by performing first stamping operations on a first portion of the stock strip which is between the first stock strip side edge and the separation line, producing a second series of articles by performing second stamping operations on a second portion of the stock strip which is between the second stock strip side edge and the separation line, separating the first and second series of articles from each other along the separation line to form first and second strips of articles while leaving a portion of the carrier strip means on each of the strips of articles, and winding the first strip of articles on the first reel by rotating the first reel in a first direction, and winding the second strip of articles on the second reel by rotating the second reel in a second direction which is opposite to the first direction so that the second strip of articles is oriented on the second reel in the same orientation as the first strip of articles on the first reel.

2. A method as set forth in claim 1 characterized in that first forming operations are carried out on the first portion of the stock strip thereby to produce laterally extending portions on the first articles which extend laterally of the plane of the stock strip in a first direction, second forming operations are carried out on the second portion of the stock strip thereby to produce laterally extending portions on the second articles which extend laterally of the plane of the stock strip in a second direction, the first and second directions being opposite directions.

3. A method as set forth in claim 2 characterized in that the articles in the first series are identical to the articles in the second series, the separation line is the centerline of the stock strip, and a carrier portion is provided on each side of the centerline when the first and second series of articles are produced whereby the carrier strip means for each of the first and second continuous strips of articles comprises a continuous carrier strip, the articles of each strip extending laterally from one of the side edges of the strip's associated carrier strip.

4. A method of manufacturing first and second continuous strips of articles, such as electrical terminals, each strip of articles comprising an article carrier strip having article carrier strip side edges, the articles extending laterally from one of the article carrier strip side edges, the strips of articles being wound in the same orientation on first and second reels, the method comprising the steps of:

providing stock strip material which has a centerline, first and second stock strip side edges, and a width which is equal to the combined widths of the first and second strips of articles, producing a first series of articles by performing first stamping operations on a first portion of the stock strip which is between the first stock strip side edge and the centerline, producing a second series of articles by performing second stamping operations on a second portion of the stock strip which is between the second stock strip side edge and the centerline, and leaving a carrier portion which extends along the centerline, which has first and second carrier portion side edges, and which has a width equal to the combined widths of the article carrier strips, separating the carrier portion along the centerline thereby to produce the first and second continuous strips of articles, the first and second carrier strip side edges becoming the one side edge of each of the article carrier strips, and winding the first strip of articles on the first reel by rotating the first reel in a first direction, and winding the second strip of articles on the second reel by rotating the second reel in a second direction which is opposite to the first direction so that the second strip of articles is oriented on the second reel in the same orientation as the first strip of articles on the first reel.

5. The method set forth in claim 4 comprising the step of performing a first forming operation on the first portion of the stock strip and thereby producing laterally extending portions on each of the first series of articles which extend laterally in a first direction from the plane of the carrier portion, and performing a second forming operation on the second portion of the stock strip and thereby producing second laterally extending portions on the second series of articles which extend laterally in a second direction from the plane of the carrier portion, the first and second directions being opposite lateral directions.

6. The method set forth in claim 5 characterized in that the stock strip carrier portion is separated by slitting.

7. The method set forth in claim 5 characterized in that the stock strip carrier portion is separated by pulling the first and second strips of articles past a slitter.

8. Apparatus for producing first and second continuous strips of articles, such as electrical terminals, from a single strip of stock material and reeling the first and second strips of articles on first and second reels with the first and second strips of articles in the same orientation on the reels, the strip of stock material having a stock strip centerline and stock strip side edges, the articles in each strip of articles being in side-by-side parallel relationship and being connected to each other by carrier means, the apparatus comprising:

a stamping machine, strip feeding means, strip separating means, and first and second reeling means, the feeding means being effective to feed the stock strip along a feed path which extends through the stamping machine and to the separating means, the feed path having a feed path centerline, which coincides with the centerline of the stock strip, and first and second feed path side edges which coincide with the first and second stock strip side edges, the stamping machine having first and second sets of punches and dies therein, the first set being located between the first feed path side edge and the feed path centerline, the second set being located between the second feed path side edge and the feed path centerline, the first and second sets of punches and dies having punches and dies for producing a first series of articles and a second series of articles in the stock strip, the strip separating means being located downstream, relative to the direction of strip feed, from the first and second sets of punches and dies, the separating means being effective to separate the strip along the stock strip centerline while it is being fed therepast, the first and second reeling means being downstream from the separating means, the first reeling means having means for rotating the first reel in a clockwise direction, the second reeling means having means for rotating the second reel in a counterclockwise direction whereby, the first and second strip of articles will be produced by the first and second sets of punches and dies and will be separated when the strip is fed past the separating means with the strips in opposite orientations and the strips will be wound on the reels so that the second strip of articles is oriented on the second reel in the same orientation as the first strip of articles on the first reel.

9. Apparatus for producing first and second continuous strips of articles as set forth in claim 8 characterized in that the first and second sets of punches and dies are spaced from the feed path centerline whereby a central carrier portion is provided between the first and second series of articles, the carrier portion having first and second carrier portion side edges, the first and second articles being integral with, and extending outwardly from, the first and second carrier portion side edges respectively whereby the carrier strip means of each of the first and second continuous strips of articles comprises a continuous carrier strip.

10. Apparatus for producing first and second continuous strips of articles as set forth in claim 9 characterized in that first and second sets of forming tools are provided for producing first and second laterally extending portions on each of the first and second articles respectively, the first laterally extending portions extending laterally of the plane of the strip in a first direction, the second laterally extending portions extending laterally of the plane of the strip in a second direction, the first and second directions being opposite directions.

11. Apparatus as set forth in claim 10 characterized in that the machine is a press which has a punch ram and a die ram, the rams being reciprocable towards and away from each other along horizontal paths of reciprocation between open and closed positions, the first and second sets of tooling being mounted on the punch ram and the die ram, the feed path extending between the punch ram and the die ram with the strip being in a vertical plane.

12. Apparatus for producing first and second continuous strips of articles as set forth in claim 10 characterized in that the separating means comprises a pair of shearing edges and the strip feeding means is located downstream from the shearing edges.

13. Apparatus for producing first and second continuous strips of articles as set forth in claim 10 characterized in that the separating means comprises a fixed shearing edge and a shearing wheel having a rotary shearing edge thereon which is cooperable with the fixed shearing edge, the strip feeding means comprises a feed wheel which is located downstream from the shearing wheel.

14. Apparatus for producing first and second continuous strips of articles as set forth in claim 13 characterized in that each of the first and second sets of punches and dies comprises an index hole punch and die which produce first and second spaced apart index holes in the first and second carrier strips, the strip feeding means comprising a feed sprocket having first and second sprocket teeth which enter the first and second index holes.

15. Apparatus for producing first and second continuous strips of articles as set forth in claim 14 characterized in that a strip positioning sprocket is provided, the positioning sprocket and the shearing wheel being rotatable on a common axis.

* * * * *